US009869058B2

(12) United States Patent
Zhang et al.

(10) Patent No.: US 9,869,058 B2
(45) Date of Patent: Jan. 16, 2018

(54) PINEAPPLE LEAF FIBER FINE TREATMENT METHOD

(71) Applicant: Tropical Agricultural Machinery Research Institute, Chinese Academy of Tropical Agricultural Sciences, Zhanjiang, Guangdong Province (CN)

(72) Inventors: Jin Zhang, Guangdong (CN); Tao Huang, Zhanjiang (CN); Mingfu Li, Zhanjiang (CN); Wenwei Lian, Zhanjiang (CN); Ganran Deng, Zhanjiang (CN); Zhongqing Ou, Zhanjiang (CN); Junyan He, Zhanjiang (CN); Zhikai Zhuang, Zhanjiang (CN)

(73) Assignee: TROPICAL AGRICULTURAL MACHINERY RESEARCH INSTITUTE, CHINESE ACADEMY OF TROPICAL AGRICULTURAL SCIENCES, Zhanjiang, Guangdong Province (CN)

( * ) Notice: Subject to any disclaimer, the term of this patent is extended or adjusted under 35 U.S.C. 154(b) by 59 days.

(21) Appl. No.: 14/994,136

(22) Filed: Jan. 12, 2016

(65) Prior Publication Data

US 2016/0273162 A1 Sep. 22, 2016

(30) Foreign Application Priority Data

Mar. 17, 2015 (CN) ..... 2015 1 0115904

(51) Int. Cl.

| | |
|---|---|
| ***D21C 1/02*** | (2006.01) |
| ***D21C 9/02*** | (2006.01) |
| ***D21C 9/10*** | (2006.01) |
| ***D21C 9/16*** | (2006.01) |
| ***D21C 9/18*** | (2006.01) |
| ***D21C 5/00*** | (2006.01) |
| ***D21C 1/10*** | (2006.01) |
| ***D21C 9/00*** | (2006.01) |
| ***D21C 9/08*** | (2006.01) |

(52) U.S. Cl.

CPC ..... *D21C 1/10* (2013.01); *D21C 5/00* (2013.01); *D21C 9/002* (2013.01); *D21C 9/007* (2013.01); *D21C 9/02* (2013.01); *D21C 9/08* (2013.01); *D21C 9/10* (2013.01); *D21C 9/16* (2013.01); *D21C 9/163* (2013.01); *D21C 9/18* (2013.01)

(58) Field of Classification Search

CPC ..... D21C 1/10; D21C 5/00; D21C 9/002; D21C 9/007; D21C 9/02; D21C 9/08; D21C 9/10; D21C 9/16; D21C 9/163; D21C 9/18; D06M 10/02; D06M 10/06; D06M 10/08; D06M 10/10; D01C 1/02

See application file for complete search history.

(56) References Cited

U.S. PATENT DOCUMENTS

2016/0273162 A1 * 9/2016 Zhang ..... D21C 1/10

FOREIGN PATENT DOCUMENTS

| | | | | | |
|---|---|---|---|---|---|
| CN | 101298701 | A | * | 11/2008 | |
| CN | 101463502 | A | * | 6/2009 | |
| CN | 102517648 | A | * | 6/2012 | |
| CN | 102808229 | A | * | 12/2012 | |
| CN | 104674353 | A | * | 6/2015 | ..... D21C 1/10 |
| CN | 105033828 | A | * | 11/2015 | |
| CN | 105040116 | A | * | 11/2015 | |
| CN | 204959101 | U | * | 1/2016 | |
| CN | 204959102 | U | * | 1/2016 | |
| GB | 2085500 | A | * | 4/1982 | ..... D01C 1/02 |

OTHER PUBLICATIONS

Machine Translation of CN-102808229 A, published on Dec. 2012.*

Machine Translation of CN-101298701 A, published on Nov. 2008.*

Machine Translation of CN-101463502 A, published on Jun. 2009.*

Machine Translation of CN-102517648 A, published on Jun. 2012.*

* cited by examiner

*Primary Examiner* — Jose Fortuna

(74) *Attorney, Agent, or Firm* — Global IP Services; Tianhua Gu

(57) ABSTRACT

The invention relates to a pineapple leaf fiber fine treatment method and belongs to the technical field of fiber fine treatment. According to the method, fibers are firstly subjected to pretreatment by ultrasonic waves, then subjected to swelling treatment by a swelling additive, then subjected to chemical degumming treatment after the swelling treatment to prepare pineapple leaf fiber degummed ramie, and finally teased and refined to obtain pineapple leaf fiber ramie stripes. A loosening fiber structure makes fibers slip easily under the effect of an external teasing and refining force, while the invention may increase the fiber looseness, improve the fiber fineness, improve the fiber quality, enable a chemical degumming additive to enter the inside of the fiber more easily, reduce sewage discharge during degumming, and decrease the degumming treatment cost.

2 Claims, No Drawings

PINEAPPLE LEAF FIBER FINE TREATMENT METHOD

CROSS REFERENCE TO RELATED PATENT APPLICATION

The present application claims the priority of CN 201510115904.3 filed Mar. 17, 2015, which application is incorporated herein by reference.

TECHNICAL FIELD OF INVENTION

The present invention relates to a fiber treatment method, and more particularly, to a pineapple leaf fiber fine treatment method, which belongs to the technical field of fiber fine treatment.

BACKGROUND OF INVENTION

Pineapple leaf fiber is a newly emerging textile raw material which is extracted from pineapple leaf and belongs to leaf fiber. It is a natural, environmental-friendly and degradable ecological fiber, which not only has the basic properties as good moisture absorption, moisture liberation and thermal conductivity or the like of common fibers, but also has excellent characteristics of disinfection and bacteriostasis, is potential to be developed into relevant natural and functional textiles, and will play an important role in military, medical treatment and daily life.

The pineapple leaf fiber may be blended with cotton to produce jeans with a drapability similar to that of cotton jeans. The pineapple leaf fiber may be blended with silk yarn to weave a high-grade dress fabric. Various furnishing fabric and upholstery fabric may be produced by using pure pineapple leaf fiber yarns produced by rotor spinning as weft yarns and using cotton or other blended yarns as warp yarns. Western-style clothes and coat fabric may be produced by blended yarns of wools and pineapple leaf fibers spun by wool spinning equipment. The blended yarns of pineapple leaf fiber and cotton produced on a jute device may be woven into window cloth, bed sheet, upholstery fabric, towel, carpet and the like. The blended yarns of terylene, acrylon and pineapple leaf fiber produced by a flax device may be used to produce knitted coats for women, socks and the like.

Moreover, the pineapple fiber has also been widely applied in industry. The pineapple leaf fiber may be used to produce needle fabric which may be served as geotechnical cloth for reinforcement and protection of reservoirs and river dikes. Because the pineapple leaf fiber yarns have higher strength and more feathers than that of the cotton yarns, the pineapple leaf fiber is also an ideal material for producing the cord fabric of a rubber conveyer belt and the core wire of a triangular belt. Canvas produced by the pineapple leaf fiber has higher strength than that of cotton canvas with the same specification. The pineapple leaf fiber may also be used for paper making, high-strength plastic, roof material, rope, fishing net and weaving handicraft and the like.

Guangxi Silk and Ramie Institute in China has found out a set of process formula technology like pineapple leaf selection, scraping, degumming, fiber refining and bleaching or the like. However, the cloth fabric is harder, and the degumming technology does not meet the production requirements on textile products yet. China Textile University has also developed studies on such systems like pineapple leaf fiber property, structure, degumming and spinning; however, the fibers subjected to degumming treatment is not thin and soft enough, and can only be blended with other fibers. Only 10N yarns can be spun out by pure pineapple leaf fibers, which has a gap to the present market demand of 20~40N ramie products.

In recent years, environment pollution has received worldwide attention, while conventional pineapple leaf fiber degumming is to soak proto fibers with acid, then put the proto fibers in a mixed solution of liquid caustic soda, trisodium phosphate and water glass for pressurizing and refining, and then perform such steps like acid soaking, base soaking, oil feeding, dewatering and baking so as to obtain fiber products. During the process, plenty of water is used, and the treated sewage contains harmful chemical compositions (for example, sulfate ions), which are difficult to recycle, and are easy to cause environment pollution. Fiber treatment needs to be performed under the conditions of strong acid, strong base and high temperature, which consumes high energy and much water, severely pollutes the environment, has long treatment time, and causes larger damage on the fibers and also has higher corrodibility on devices. It is urgent to research a pineapple leaf fiber processing technology which can reduce the hardness of the pineapple leaf fiber, improve the fineness and compliance of the fiber, has small pollution on the environment, and is suitable for textile production.

Chinese invention "Pineapple Leaf Fiber Degum Process" (application No. 200910036673.1) discloses a pineapple leaf fiber chemical degumming process, which may produce fibers with a fineness of 550N, but the energy consumption during the process is high, and the pollution to the environment is severe. Chinese invention "Pineapple Leaf Fiber Extension Refining Method" (application No. 200610024817.8) discloses to spray an additive to the pineapple leaf fiber for curing, so as to refine the fiber, but the chemical compositions used during the treatment are easy to cause environment pollution.

SUMMARY OF INVENTION

The object of the present invention is to overcome the defects of the prior art and provides a pineapple leaf fiber fine processing and treatment technology, which employs ultrasonic treatment and swelling treatment to loosen a fiber structure, so as to solve the problems of long treatment time of pineapple leaf fiber, big dosage of reagent as well as poor fiber quality and spinnability, and reduce environment pollution.

to fulfill the foregoing object, the present invention employs the following technical solution. A pineapple leaf fiber fine treatment method includes the following steps:

(1) pineapple leaf fiber presoaking treatment:

subjecting pineapple leaf fiber in a pretreatment solution to ultrasonic treatment, and then subjecting the pineapple leaf fiber to washing and dewatering treatment;

(2) swelling treatment:

putting the pineapple leaf fiber after pretreatment into a compound swelling additive solution for swelling treatment at a temperature of 20~75° C., a PH value of 3~10 and a reaction time of 20~120 min;

(3) degumming and bleaching treatment:

subjecting the pineapple leaf fiber after swelling treatment to high temperature degumming treatment, then subjecting the pineapple leaf fiber to washing and dewatering, and then putting the pineapple leaf fiber into 5~15% hydrogen peroxide to bleach for 20~50 min at a temperature of 60~95° C.;

(4) oil feeding:
soaking the bleached pineapple leaf fiber in a solution containing 0.5~3% modified silicone oil agent for 1~2 h at a soaking temperature of 30~75° C.;
(5) subjecting the treated pineapple leaf fiber to dewatering, shaking and drying to obtain the pineapple leaf fiber degummed ramie; and
(6) teasing:
spraying an emulsifying oil agent on the pineapple leaf fiber degummed ramie, the dosage of the emulsifying oil agent being 4%-10% of the weight of the fiber, standing in a curing room for a curing time of 24~96 h at a curing temperature of 35~50° C.; and then performing mechanical teasing and extension refining to prepare the pineapple leaf fiber ramie stripes.

The pretreatment solution of the pineapple leaf fiber in step (1) is a sulfuric acid solution with a water or mass concentration of 0.05~1.00%, a temperature of 20~80° C., and a bath ratio of 1:10~1:20.

The ultrasonic frequency of the ultrasonic treatment in step (1) is 20~40 KHz, and the time is 20~120 min.

The compound swelling additive solution of the pineapple leaf fiber in step (2) is compounded of a swelling protein agent, cellulase, hemicellulase, pectinase and non-ionic penetrating agent, with a dosage of 0.5~2% of the weight of the pineapple leaf fiber, and a bath ratio of 1:10~1:30.

The dosage of the swelling protein agent in the compound swelling additive solution of the pineapple leaf fiber in step (2) is 0.5~1.5% of the weight of the pineapple leaf fiber, the dosage of the cellulase is 0.3~2.0% of the weight of the pineapple leaf fiber, the dosage of the hemicellulase is 0.5~2.0% of the weight of the pineapple leaf fiber, the dosage of the pectinase is 0.5~2.0% of the weight of the pineapple leaf fiber, and the dosage of the penetrating agent is 0.5~2.5% of the weight of the pineapple leaf fiber.

The present invention has the advantageous effects that: according to the pineapple leaf fiber fine treatment method, fibers are firstly subjected to pretreatment by ultrasonic waves, then subjected to swelling treatment, and then subjected to chemical degumming treatment, and are finally teased and refined to obtain pineapple leaf fiber degummed ramie stripes. The pineapple leaf fiber fine treatment method according to the present invention reduces degumming pollution, energy consumption and cost, and has low fiber damage and high ramie stripe producing rate. The crystallinity of the pineapple leaf fiber after the degumming treatment according to the method is decreased, an amorphous region of the pineapple leaf fiber becomes loose, and the fiber swells significantly, so that the chemical degumming additive is easier to enter the inside of the fiber, those substances in the fiber like lignin and pectin can be dissolved out easily, the sewage discharge during the degumming process is reduced, the degumming treatment cost is reduced, the spinnability of the fiber is improved, and the loosening of the fiber structure enables the fiber to slip easily under the effect of an external teasing and refining force, and the fiber fineness and compliance of the fiber are improved. The pineapple leaf fiber after the degumming treatment according to the method has the characteristics of loosening and flexibility, so that the fiber quality is improved.

DETAILED DESCRIPTION OF INVENTION

The invention will be further described in details hereinafter by examples, and these examples are merely for explanation of the invention, and are not intended to limit the scope of the invention.

Embodiment 1

A pineapple leaf fiber fine treatment method includes the following steps:
(1) pineapple leaf fiber presoaking treatment:
the pineapple leaf fiber was subjected to ultrasonic treatment in a pretreatment solution, wherein the pretreatment solution was 0.15% sulfuric acid solution with a temperature of 50° C., a bath ratio of 1:15, an ultrasonic frequency of 30 KHz, and a time of 40 min; then the pineapple leaf fiber was subjected to washing and dewatering treatment;
(2) swelling treatment:
the pineapple leaf fiber after pretreatment was put into a compound swelling additive solution for swelling treatment at a temperature of 55° C., a PH value of 7 and a reaction time of 40 min;
(3) degumming and bleaching treatment:
the pineapple leaf fiber after swelling treatment was subjected to high temperature degumming treatment, then the pineapple leaf fiber was subjected to washing and dewatering, and then put into 5~15% hydrogen peroxide to bleach for 30 min at a temperature of 70° C.;
(4) oil feeding:
the bleached pineapple leaf fiber was soaked in a solution containing 1% modified silicone oil agent for 1 h at a soaking temperature of 75° C.;
(5) the treated pineapple leaf fiber was subjected to dewatering, shaking and drying to obtain the pineapple leaf fiber degummed ramie; and
(6) teasing:
an emulsifying oil agent was sprayed on the pineapple leaf fiber degummed ramie, the dosage of the emulsifying oil agent being 4% of the weight of the fiber, stood in a curing room for a curing time of 96 h at a curing temperature of 35° C.; and then mechanical teasing and extension refining were performed to prepare the pineapple leaf fiber ramie stripes.

The compound swelling additive solution of the pineapple leaf fiber is compounded of a swelling protein agent, cellulase, hemicellulase, pectinase and non-ionic penetrating agent, with a dosage of 0.5% of the weight of the pineapple leaf fiber, and a bath ratio of 1:10, wherein the dosage of the swelling protein agent in the compound swelling additive solution of the pineapple leaf fiber is 0.5% of the weight of the pineapple leaf fiber, the dosage of the cellulase is 1.0% of the weight of the pineapple leaf fiber, the dosage of the hemicellulase is 0.5% of the weight of the pineapple leaf fiber, the dosage of the pectinase is 1.0% of the weight of the pineapple leaf fiber, and the dosage of the penetrating agent is 1.0% of the weight of the pineapple leaf fiber.

Embodiment 2

A pineapple leaf fiber fine treatment method includes the following steps:
(1) pineapple leaf fiber presoaking treatment:
the pineapple leaf fiber was subjected to ultrasonic treatment in a pretreatment solution, wherein the pretreatment solution was water with a water temperature of 45° C., a bath ratio of 1:15, an ultrasonic frequency of 30 KHz, and a time of 50 min; then the pineapple leaf fiber was subjected to washing and dewatering treatment;
(2) swelling treatment:
the pineapple leaf fiber after pretreatment was put into a compound swelling additive solution for swelling treatment at a temperature of 60° C., a PH value of 7 and a reaction time of 50 min;

(3) degumming and bleaching treatment:

the pineapple leaf fiber after swelling treatment was subjected to high temperature degumming treatment, then the pineapple leaf fiber was subjected to washing and dewatering, and then put into 10% hydrogen peroxide to bleach for 40 min at a temperature of 80° C.;

(4) oil feeding:

the bleached pineapple leaf fiber was soaked in a solution containing 0.5% modified silicone oil agent for 1 h at a soaking temperature of 60° C.;

(5) the treated pineapple leaf fiber was subjected to dewatering, shaking and drying to obtain the pineapple leaf fiber degummed ramie; and (6) teasing:

an emulsifying oil agent was sprayed on the pineapple leaf fiber degummed ramie, the dosage of the emulsifying oil agent being 6% of the weight of the fiber, stood in a curing room for a curing time of 72 h at a curing temperature of 40° C.; and then mechanical teasing and extension refining were performed to prepare the pineapple leaf fiber ramie stripes.

The compound swelling additive solution of the pineapple leaf fiber is compounded of a swelling protein agent, cellulase, hemicellulase, pectinase and non-ionic penetrating agent, with a dosage of 1.0% of the weight of the pineapple leaf fiber, and a bath ratio of 1:15, wherein the dosage of the swelling protein agent in the compound swelling additive solution of the pineapple leaf fiber is 1.0% of the weight of the pineapple leaf fiber, the dosage of the cellulase is 0.5% of the weight of the pineapple leaf fiber, the dosage of the hemicellulase is 1.0% of the weight of the pineapple leaf fiber, the dosage of the pectinase is 1.0% of the weight of the pineapple leaf fiber, and the dosage of the penetrating agent is 1.0% of the weight of the pineapple leaf fiber.

Embodiment 3

A pineapple leaf fiber fine treatment method includes the following steps:

(1) pineapple leaf fiber presoaking treatment:

the pineapple leaf fiber was subjected to ultrasonic treatment in a pretreatment solution, wherein the pretreatment solution was 1.0% sulfuric acid solution with a temperature of 60° C., a bath ratio of 1:15, an ultrasonic frequency of 25 KHz, and a time of 40 min; then the pineapple leaf fiber was subjected to washing and dewatering treatment;

(2) swelling treatment:

the pineapple leaf fiber after pretreatment was put into a compound swelling additive solution for swelling treatment at a temperature of 50° C., a PH value of 6 and a reaction time of 50 min;

(3) degumming and bleaching treatment:

the pineapple leaf fiber after swelling treatment was subjected to high temperature degumming treatment, then the pineapple leaf fiber was subjected to washing and dewatering, and then put into 15% hydrogen peroxide to bleach for 30 min at a temperature of 70° C.;

(4) oil feeding:

the bleached pineapple leaf fiber was soaked in a solution containing 0.8% modified silicone oil agent for 1.5 h at a soaking temperature of 70° C.;

(5) the treated pineapple leaf fiber was subjected to dewatering, shaking and drying to obtain the pineapple leaf fiber degummed ramie; and (6) teasing:

an emulsifying oil agent was sprayed on the pineapple leaf fiber degummed ramie, the dosage of the emulsifying oil agent being 5% of the weight of the fiber, stood in a curing room for a curing time of 72 h at a curing temperature of 35° C.; and then mechanical teasing and extension refining were performed to prepare the pineapple leaf fiber ramie stripes.

The compound swelling additive solution of the pineapple leaf fiber is compounded of a swelling protein agent, cellulase, hemicellulase, pectinase and non-ionic penetrating agent, with a dosage of 1.0% of the weight of the pineapple leaf fiber, and a bath ratio of 1:20, wherein the dosage of the swelling protein agent in the compound swelling additive solution of the pineapple leaf fiber is 1.5% of the weight of the pineapple leaf fiber, the dosage of the cellulase is 1.0% of the weight of the pineapple leaf fiber, the dosage of the hemicellulase is 1.0% of the weight of the pineapple leaf fiber, the dosage of the pectinase is 1.0% of the weight of the pineapple leaf fiber, and the dosage of the penetrating agent is 1.0% of the weight of the pineapple leaf fiber.

Embodiment 4

A pineapple leaf fiber fine treatment method includes the following steps:

(1) pineapple leaf fiber presoaking treatment:

the pineapple leaf fiber was subjected to ultrasonic treatment in a pretreatment solution, wherein the pretreatment solution was 0.05% sulfuric acid solution with a temperature of 20° C., a bath ratio of 1:10, an ultrasonic frequency of 20 KHz, and a time of 20 min; then the pineapple leaf fiber was subjected to washing and dewatering treatment;

(2) swelling treatment:

the pineapple leaf fiber after pretreatment was put into a compound swelling additive solution for swelling treatment at a temperature of 20° C., a PH value of 3 and a reaction time of 20 min;

(3) degumming and bleaching treatment:

the pineapple leaf fiber after swelling treatment was subjected to high temperature degumming treatment, then the pineapple leaf fiber was subjected to washing and dewatering, and then put into 5% hydrogen peroxide to bleach for 20 min at a temperature of 60° C.;

(4) oil feeding:

the bleached pineapple leaf fiber was soaked in a solution containing 0.5% modified silicone oil agent for 1 h at a soaking temperature of 30° C.;

(5) the treated pineapple leaf fiber was subjected to dewatering, shaking and drying to obtain the pineapple leaf fiber degummed ramie; and (6) teasing:

an emulsifying oil agent was sprayed on the pineapple leaf fiber degummed ramie, the dosage of the emulsifying oil agent being 7% of the weight of the fiber, stood in a curing room for a curing time of 48 h at a curing temperature of 40° C.; and then mechanical teasing and extension refining were performed to prepare the pineapple leaf fiber ramie stripes.

The compound swelling additive solution of the pineapple leaf fiber is compounded of a swelling protein agent, cellulase, hemicellulase, pectinase and non-ionic penetrating agent, with a dosage of 0.5% of the weight of the pineapple leaf fiber, and a bath ratio of 1:10, wherein the dosage of the swelling protein agent in the compound swelling additive solution of the pineapple leaf fiber is 0.5% of the weight of the pineapple leaf fiber, the dosage of the cellulase is 0.3% of the weight of the pineapple leaf fiber, the dosage of the hemicellulase is 0.5% of the weight of the pineapple leaf fiber, the dosage of the pectinase is 0.5% of the weight of the pineapple leaf fiber, and the dosage of the penetrating agent is 0.5% of the weight of the pineapple leaf fiber.

Embodiment 5

A pineapple leaf fiber fine treatment method includes the following steps:

(1) pineapple leaf fiber presoaking treatment:

the pineapple leaf fiber was subjected to ultrasonic treatment in a pretreatment solution, wherein the pretreatment solution was 1.0% sulfuric acid solution with a temperature of 80° C., a bath ratio of 1:20, an ultrasonic frequency of 40 KHz, and a time of 120 min; then the pineapple leaf fiber was subjected to washing and dewatering treatment;

(2) swelling treatment:

the pineapple leaf fiber after pretreatment was put into a compound swelling additive solution for swelling treatment at a temperature of 75° C., a PH value of 10 and a reaction time of 120 min;

(3) degumming and bleaching treatment:

the pineapple leaf fiber after swelling treatment was subjected to high temperature degumming treatment, then the pineapple leaf fiber was subjected to washing and dewatering, and then put into 15% hydrogen peroxide to bleach for 30 min at a temperature of 95° C.;

(4) oil feeding:

the bleached pineapple leaf fiber was soaked in a solution containing 3% modified silicone oil agent for 2 h at a soaking temperature of 75° C.;

(5) the treated pineapple leaf fiber was subjected to dewatering, shaking and drying to obtain the pineapple leaf fiber degummed ramie; and (6) teasing:

an emulsifying oil agent was sprayed on the pineapple leaf fiber degummed ramie, the dosage of the emulsifying oil agent being 10% of the weight of the fiber, stood in a curing room for a curing time of 24 h at a curing temperature of 45° C.; and then mechanical teasing and extension refining were performed to prepare the pineapple leaf fiber ramie stripes.

The compound swelling additive solution of the pineapple leaf fiber is compounded of a swelling protein agent, cellulase, hemicellulase, pectinase and non-ionic penetrating agent, with a dosage of 2% of the weight of the pineapple leaf fiber, and a bath ratio of 1:30, wherein the dosage of the swelling protein agent in the compound swelling additive solution of the pineapple leaf fiber is 1.5% of the weight of the pineapple leaf fiber, the dosage of the cellulase is 2.0% of the weight of the pineapple leaf fiber, the dosage of the hemicellulase is 2.0% of the weight of the pineapple leaf fiber, the dosage of the pectinase is 2.0% of the weight of the pineapple leaf fiber, and the dosage of the penetrating agent is 2.5% of the weight of the pineapple leaf fiber.

What is claimed is:

1. A pineapple leaf fiber treatment method, comprising the following steps:

(1) pineapple leaf fiber presoaking treatment:

subjecting pineapple leaf fiber in a pretreatment solution to ultrasonic treatment, and then subjecting the pineapple leaf fiber to washing and dewatering treatment; the pretreatment solution is a sulfuric acid solution with mass concentration of 0.05~1.00% with water, a temperature of 20~80° C., and a bath ratio of 1:10~1:20; an ultrasonic frequency of the ultrasonic treatment in step (1) is 20~40 KHz and a time is 20~120 min;

(2) swelling treatment:

putting the pineapple leaf fiber after pretreatment into a compound swelling additive solution for swelling treatment at a temperature of 20~75° C., a PH value of 3~10 and a reaction time of 20~120 min; the compound swelling additive solution is a compounded solution by two or more agents selected from cellulase, hemicellulase, pectinase and non-ionic penetrating agent, with a dosage of 0.5~2% of the weight of the pineapple leaf fiber, and a bath ratio of 1:10~1:30;

(3) degumming and bleaching treatment:

subjecting the pineapple leaf fiber after swelling treatment to a chemical degumming treatment, then subjecting the pineapple leaf fiber to a washing and a dewatering, and then putting the pineapple leaf fiber into 5~15% hydrogen peroxide to bleach for 20~50 min at a temperature of 60~95° C.;

(4) oil feeding:

soaking the bleached pineapple leaf fiber in a solution containing 0.5~3% modified silicone oil agent for 1~2 h at a soaking temperature of 30~75° C.;

(5) subjecting the treated pineapple leaf fiber to dewatering, shaking and drying to obtain the degummed pineapple leaf fiber; and (6) teasing:

spraying an emulsifying oil agent on the degummed pineapple leaf fiber, the dosage of the emulsifying oil agent being 4%~10% of the weight of the fiber, standing in a curing room for a curing time of 24~96 h at a curing temperature of 35~50° C.; and then performing mechanical teasing and extension refining to prepare the pineapple leaf fiber.

2. The pineapple leaf fiber fine treatment method according to claim 1, wherein the dosage of the swelling protein agent in the compound swelling additive solution of the pineapple leaf fiber in step (2) is 0.5~1.5% of the weight of the pineapple leaf fiber, the dosage of the cellulase is 0.3~2.0% of the weight of the pineapple leaf fiber, the dosage of the hemicellulase is 0.5~2.0% of the weight of the pineapple leaf fiber, the dosage of the pectinase is 0.5~2.0% of the weight of the pineapple leaf fiber, and the dosage of the penetrating agent is 0.5~2.5% of the weight of the pineapple leaf fiber.

* * * * *